US006315677B1

(12) United States Patent
Sandlin

(10) Patent No.: US 6,315,677 B1
(45) Date of Patent: Nov. 13, 2001

(54) GOLF BALL CATCHING FUNNEL

(76) Inventor: David Sandlin, 4895 Northorne, Fresno, CA (US) 93704

( * ) Notice: Subject to any disclaimer, the term of this patent is extended or adjusted under 35 U.S.C. 154(b) by 0 days.

(21) Appl. No.: 09/514,786

(22) Filed: Feb. 28, 2000

(51) Int. Cl.[7] ..... A63B 69/36
(52) U.S. Cl. ..... 473/197; 473/194
(58) Field of Search ..... 473/150–155, 473/163, 164, 170, 172, 173, 190–197, 431, 432, 460, 462, 478, 503; 273/395, 396, 398–402

(56) References Cited

U.S. PATENT DOCUMENTS

| | | | | |
|---|---|---|---|---|
| 2,195,634 | * | 4/1940 | Shelley, Jr. | 473/196 |
| 3,918,711 | * | 11/1975 | Zak | 473/197 |
| 4,141,557 | * | 2/1979 | Ingwersen | 473/197 |
| 4,643,423 | * | 2/1987 | Wright | 473/197 |
| 4,750,744 | * | 6/1988 | Michalec | 473/197 |
| 5,286,029 | * | 2/1994 | Smit | 473/197 |

* cited by examiner

*Primary Examiner*—Mark S. Graham
(74) *Attorney, Agent, or Firm*—Jack Lo

(57) ABSTRACT

The present golf ball catching funnel is comprised of a horizontal frame, a funnel-shaped sheet suspended within the frame, and legs elevating the frame and sheet off the ground. The frame is adapted to be positioned against the front of a golf ball driving net for catching golf balls as they drop from the net. Detachable fasteners along a rear edge of the sheet secure the golf ball catching funnel against the driving net, and thus prevent the golf balls from falling between the catching funnel and the driving net. A resilient tube with a longitudinal split is clipped around a front edge of the frame for preventing the golf balls from rolling off as they bounce back from the driving net. A hole is provided in the sheet for directing the golf balls into a bucket below to stretch taut the sheet and generally smooth out any wrinkles and ripples which might prevent the golf balls from rolling toward said hole.

8 Claims, 1 Drawing Sheet

GOLF BALL CATCHING FUNNEL

BACKGROUND OF THE INVENTION

1. Field of the Invention

This invention relates generally to devices for catching golf balls.

2. Prior Art

Practicing driving or hitting a golf ball hard with a club is a popular activity. Players get a bucket of golf balls, and repeatedly drive them one after another onto a driving range from the same standing position. There are large outdoor driving ranges where the balls are driven a great distance across a green or lawn. There are also small driving ranges or even indoor facilities where there is insufficient room to let the balls travel their full trajectories. Therefore, driving screens or nets are typically used for stopping the ball in mid flight. The balls fall onto the ground in front of the screen or net and scatter all about. The player must bend over to pick up all the balls over a wide area. The tedious collection process must be repeated each time the supply of balls is used up.

OBJECTIVES OF THE INVENTION

Accordingly, the objectives of the present golf ball catching funnel are:

- to catch golf balls as they drop from a driving screen or net;
- to reliably direct the balls conveniently into a bucket to eliminate the need to pick up the balls individually;
- to prevent the balls from rolling off as they bounce back from the net; and
- to prevent the balls from falling between itself and the net.

Further objectives of the present invention will become apparent from a consideration of the drawings and ensuing description.

BRIEF SUMMARY OF THE INVENTION

The present golf ball catching funnel is comprised of a horizontal frame, a funnel-shaped sheet suspended within the frame, and legs elevating the frame and sheet off the ground. The frame is adapted to be positioned against the front of a golf ball driving net for catching golf balls as they drop from the net. Detachable fasteners along a rear edge of the sheet secure the golf ball catching funnel against the driving net, and thus prevent the golf balls from falling between the catching funnel and the driving net. A resilient tube with a longitudinal split is clipped around a front edge of the frame for preventing the golf balls from rolling off as they bounce back from the driving net. A hole is provided in the sheet for directing the golf balls into a bucket below. A weight is attached to the sheet adjacent the hole to stretch taut the sheet and generally smooth out any wrinkles and ripples which might prevent the golf balls from rolling toward said hole.

DRAWING REFERENCE NUMERALS

10. Golf Ball Catching Funnel
11. Frame
12. Flexible Sheet
13. Legs
14. Tubing
15. Connectors
16. Sleeves
17. Tubing
18. Golf Ball Net
19. Golf Ball
20. Eyelet
21. Cord
22. Foam Tube
23. Split
24. Hole
25. Weight
26. Bucket
27. Connector
28. Sockets
29. Pins
30. Holes

DETAILED DESCRIPTION OF THE INVENTION

Figure 1:
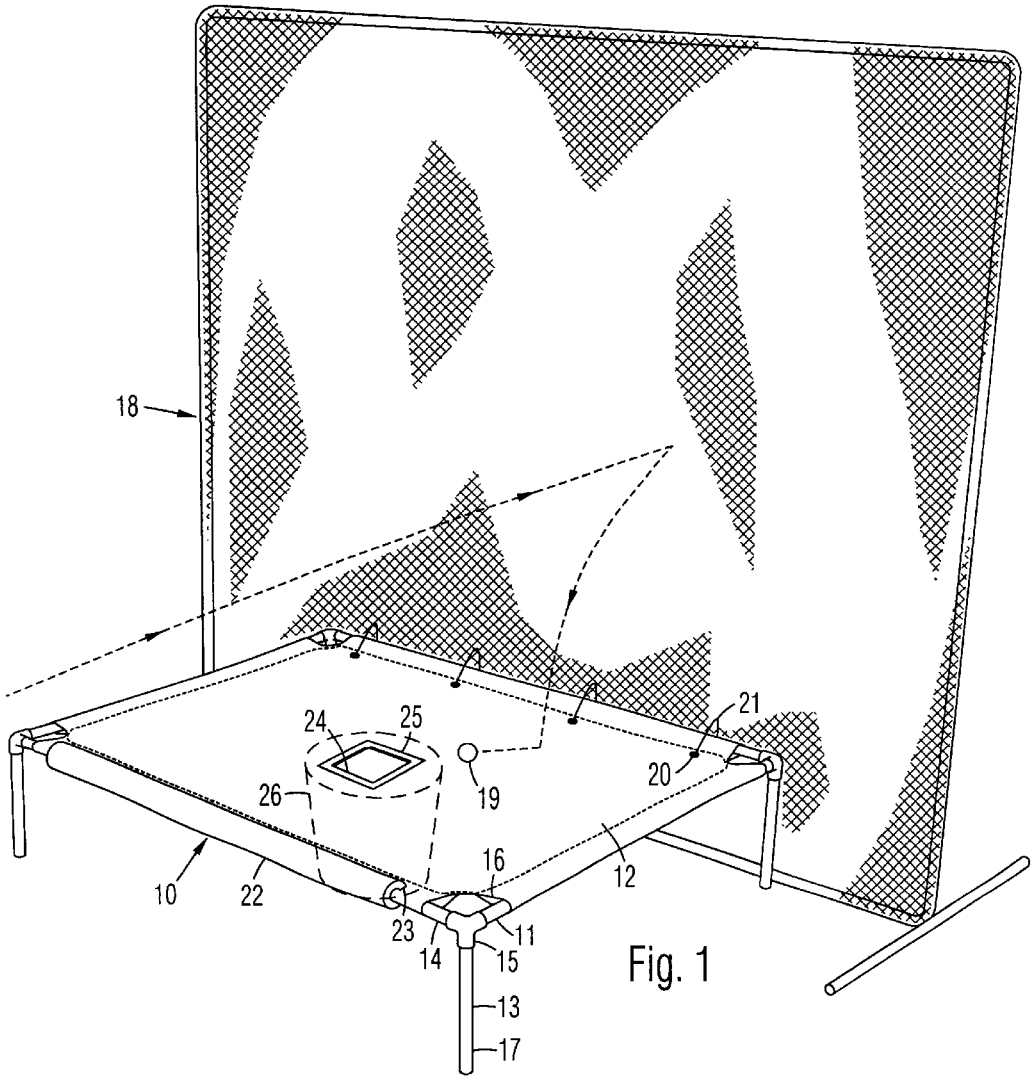
FIG. 1 is a front perspective view of the present golf ball catching funnel attached to a conventional driving net.
Figure 2:
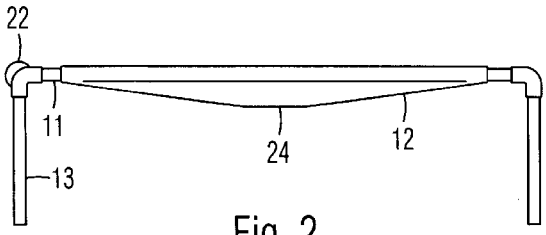
FIG. 2. is a side view of the golf ball catching funnel alone.

A preferred embodiment of the present golf ball catching funnel 10 is shown in a front perspective view in FIG. 1. It is comprised of a horizontal frame 11, a flexible funnel-shaped sheet 12 suspended within frame 11, and legs 13 elevating frame 11 and sheet 12 off the ground. Frame 11 is preferably comprised of a plurality of plastic or metal tubing 14 connected by removable corner connectors 15. Although frame 11 is shown as being rectangular, it may be of any other shape. Sheet 12 preferably includes edges folded into longitudinal sleeves 16 through which tubing 14 are inserted. Legs 13 are preferably plastic or metal tubing 17 which are attached to respective connectors 15. Frame 11 and connectors 15 are preferably separable from each other for disassembly and compact storage. The shallow funnel shape of sheet 12 is clearly shown in a side view in FIG. 2.

Referring back to FIG. 1, frame 11 is adapted to be positioned against a front side of a conventional golf ball driving screen or net 18 for catching golf balls 19 as they drop from net 18. A plurality of eyelets 20 are provided along a rear edge of sheet 12. Catching funnel 10 is adapted to be closely tied to driving net 18 with detachable fasteners or cords 21 passed through net 18 and eyelets 20, and thus prevent golf balls 19 from falling between catching funnel 10 and driving net 18. Alternatively, cords 21 may be permanently attached to sheet 12. Also, another type of detachable fastener may be used, e.g., clips or hooks. A thick resilient foam tube 22 with a longitudinal split 23 is clipped around a front edge of frame 11 for preventing golf balls 19 from rolling off as they bounce back from net 18. Foam tube 22 also protects frame 11 from direct hits by golf balls 19. Additional foam tubes 22 may be attached to the other edges of frame 11.

A hole 24 is provided in sheet 12. Although hole 24 is shown as being at a center of sheet 12, it may be arranged in other positions, such as near the front. Hole 24 may be of any shape. Funnel-shaped sheet 12 is adapted to direct golf balls 19 through hole 24 into a bucket 26. A weight 25 is attached to sheet 12 adjacent hole 24 to stretch taut sheet 12 and generally smooth out wrinkles and ripples that might prevent golf balls 19 from rolling toward hole 24. Weight 25 is preferably a sheet of lead with edges around a hole thereon crimped around hole 24 of sheet 12.

Figure 3:
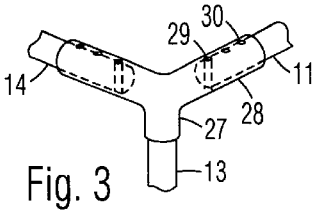
FIG. 3 is a front perspective view of an alternative connector thereof.

An alternative corner connector 27 is shown enlarged in FIG. 3. It includes elongated sleeves 28 in which corresponding ends of tubing 14 are inserted. A pin 29 inserted through one of a series of holes 30 in each sleeve 28 locks the end of tubing 14 in selectable positions along sleeve 28 to adjust the size of frame 11 and stretch taut the funnel-shaped sheet.

Accordingly, the present golf ball catching funnel catches golf balls as they drop from a driving screen or net. It prevents the balls from rolling off as they bounce back from the net. It prevents the balls from falling between itself and the net. It reliably directs the balls conveniently into a bucket to eliminate the need to pick up the balls individually.

Although the above description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

I claim:

1. A golf ball catching funnel, comprising:

a horizontal frame for being positioned against a front side of a vertical golf ball driving net;

a funnel-shaped sheet suspended within said frame and forming a shallow funnel, said funnel-shaped sheet for catching golf balls falling from the net;

a plurality of legs elevating said frame and said funnel-shaped sheet off the ground; and a hole in said funnel-shaped sheet, said hole for being positioned over a bucket, said funnel-shaped sheet for directing the golf balls through said hole and into said bucket;

wherein said frame is comprised of a plurality of tubing detachably connected by comer connectors, and said legs are respectively and detachably attached to said comer connectors, each of said comer connectors includes a pair of horizontally elongated sleeves, said tubing are locked in selectable positions along said elongated sleeves by a pin extending through one of a series of holes in each of said elongates sleeves, thereby said frame is adjustable in size to stretch taut said funnel-shaped sheet.

2. A golf ball catching funnel, comprising:

a horizontal frame for being positioned against a front side of a vertical golf ball driving net;

a funnel-shaped sheet suspended within said frame and forming a shallow funnel, said funnel-shaped sheet for catching golf balls falling from the net;

a plurality of legs elevating said frame and said funnel-shaped sheet off the ground; and a hole in said funnel-shaped sheet, said hole for being positioned over a bucket, said funnel-shaped sheet for directing the golf balls through said hole and into said bucket;

further including a resilient tube with a longitudinal split clipped around an edge of said frame for preventing the golf balls from rolling off as the golf balls bounce back from the net, said resilient tube also protecting said frame from direct hits by the golf balls.

3. A golf ball catching funnel, comprising:

a horizontal frame for being positioned against a front side of a vertical golf ball driving net;

a flexible sheet suspended within said frame and forming a shallow funnel, said sheet for catching golf balls falling from the net;

a plurality of legs elevating said frame and said sheet off the ground;

a hole in said sheet for being positioned over a bucket, said sheet for directing the golf balls through said hole and into said bucket; and a weight attached to said sheet adjacent said hole, said weight stretching taut said sheet to generally smooth out any wrinkles and ripples which might prevent the golf balls from rolling toward said hole;

wherein said frame is comprised of a plurality of tubing detachably connected by corner connectors, and said legs are respectively and detachably attached to said corner connectors.

4. A golf ball catching funnel, comprising:

a horizontal frame for being positioned against a front side of a vertical golf ball driving net;

a flexible sheet suspended within said frame and forming a shallow funnel, said sheet for catching golf balls falling from the net;

a plurality of legs elevating said frame and said sheet off the ground;

a hole in said sheet for being positioned over a bucket, said sheet for directing the golf balls through said hole and into said bucket; and a weight attached to said sheet adjacent said hole, said weight stretching taut said sheet to generally smooth out any wrinkles and ripples which might prevent the golf balls from rolling toward said hole;

wherein said frame is comprised of a plurality of tubing detachably connected by comer connectors, and said legs are respectively and detachably attached to said comer connectors, each of said comer connectors includes a pair of horizontally elongated sleeves, said tubing are locked in selectable positions along said elongated sleeves by a pin extending through one of a series of holes in each of said elongates sleeves, thereby said frame is adjustable in size to stretch taut said funnel-shaped sheet.

5. A golf ball catching funnel, comprising:

a horizontal frame for being positioned against a front side of a vertical golf ball driving net;

a flexible sheet suspended within said frame and forming a shallow funnel, said sheet for catching golf balls falling from the net;

a plurality of legs elevating said frame and said sheet off the ground;

a hole in said sheet for being positioned over a bucket, said sheet for directing the golf balls through said hole and into said bucket; and a weight attached to said sheet adjacent said hole, said weight stretching taut said sheet to generally smooth out any wrinkles and ripples which might prevent the golf balls from rolling toward said hole;

further including detachable fasteners comprised of a plurality of cords respectively extending through a plurality of eyelets on said sheet.

6. A golf ball catching funnel, comprising:

a horizontal frame for being positioned against a front side of a vertical golf ball driving net;

a flexible sheet suspended within said frame and forming a shallow funnel, said sheet for catching golf balls falling from the net;

a plurality of legs elevating said frame and said sheet off the ground;

a hole in said sheet for being positioned over a bucket, said sheet for directing the golf balls through said hole and into said bucket; and a weight attached to said sheet adjacent said hole, said weight stretching taut said sheet to generally smooth out any wrinkles and ripples which might prevent the golf balls from rolling toward said hole;

further including a resilient tube with a longitudinal split clipped around an edge of said frame for preventing the golf balls from rolling off as the golf balls bounce back from the net, said resilient tube also protecting said frame from direct hits by the golf balls.

7. A golf ball catching funnel, comprising:

a horizontal frame for being positioned against a front side of a vertical golf ball driving net;

a funnel-shaped sheet suspended within said frame and forming a shallow funnel, said funnel-shaped sheet for catching golf balls falling from the net;

a plurality of legs elevating said frame and said funnel-shaped sheet off the ground;

a hole in said funnel-shaped sheet, said hole for being positioned over a bucket, said funnel-shaped sheet for directing the golf balls through said hole and into said bucket; and a plurality of detachable fasteners arranged along an edge of said sheet for securing said golf ball catching funnel to the net for preventing the golf balls from falling between said golf ball catching funnel and the net;

wherein said frame is comprised of a plurality of tubing detachably connected by comer connectors, and said legs are respectively and detachably attached to said corner connectors, each of said comer connectors includes a pair of horizontally elongated sleeves, said tubing are locked in selectable positions along said elongated sleeves by a pin extending through one of a series of holes in each of said elongates sleeves, thereby said frame is adjustable in size to stretch taut said funnel-shaped sheet.

8. A golf ball catching funnel, comprising:

a horizontal frame for being positioned against a front side of a vertical golf ball driving net;

a funnel-shaped sheet suspended within said frame and forming a shallow funnel, said funnel-shaped sheet for catching golf balls falling from the net;

a plurality of legs elevating said frame and said funnel-shaped sheet off the ground;

a hole in said funnel-shaped sheet, said hole for being positioned over a bucket, said funnel-shaped sheet for directing the golf balls through said hole and into said bucket; and a plurality of detachable fasteners arranged along an edge of said sheet for securing said golf ball catching funnel to the net for preventing the golf balls from falling between said golf ball catching funnel and the net;

further including a resilient tube with a longitudinal split clipped around an edge of said frame for preventing the golf balls from rolling off as the golf balls bounce back from the net, said resilient tube also protecting said frame from direct hits by the golf balls.

* * * * *